US006060841A

United States Patent [19]

Niiyama et al.

[11] Patent Number: 6,060,841

[45] Date of Patent: May 9, 2000

[54] FIELD EMISSION ELEMENT

[75] Inventors: Takahiro Niiyama; Shigeo Itoh, both of Mobara, Japan

[73] Assignee: Futaba Denshi Kogyo Kabushiki Kaisha, Mobara, Japan

[21] Appl. No.: 09/093,089

[22] Filed: Jun. 8, 1998

[30] Foreign Application Priority Data

Jun. 9, 1997 [JP] Japan ..... 9-150866

[51] Int. Cl.[7] ..... G09G 3/10

[52] U.S. Cl. ..... 315/169.3; 315/169.4; 313/309; 313/336; 445/50

[58] Field of Search ..... 315/169.3, 169.4, 315/169.1; 313/309, 336, 351; 445/50, 51, 35

[56] References Cited

U.S. PATENT DOCUMENTS 4,940,916 7/1990 Borel ..... 313/306
5,194,780 3/1993 Meyer ..... 315/169.3
5,594,298 1/1997 Itoh et al. ..... 313/336
5,892,321 4/1999 Itoh et al. ..... 313/336

*Primary Examiner*—Haissa Philogene
*Attorney, Agent, or Firm*—Oblon, Spivak, McClelland, Maier & Neustadt, P.C.

[57] ABSTRACT

A field emission element that can prevent one cathode electrode line from being completely disabled due to a short circuit between an emitter electrode and a gate electrode. One cathode electrode line consists of a stripe cathode conductor and plural island electrodes arranged on the one side of the cathode conductor. The gate electrode is disposed on the insulating layer overlaying the upper surface of each island electrode. The first resistance layer and the second resistance layer each having a different resistance value are laminated in a current control resistance layer. When excessive current flows through the emitter cone, the laminated thick-film portion is destroyed so that only the island electrode connected to the emitter cone is electrically separated off from the cathode conductor. One second resistance layer is locally laminated on the first resistance layer and for each of plural island electrodes.

13 Claims, 3 Drawing Sheets

FIELD EMISSION ELEMENT

BACKGROUND OF THE INVENTION

1. Field of the Invention

This invention relates to a field emission element provided with field emission cathodes known as cold cathodes.

2. Description of the Related Art

When the electric field applied at a surface of a metal or semiconductor is as large as $10^9$ V/m, electrons pass through the potential barrier because of the tunnel effect, thus emitting out in a vacuum even at room temperatures. This phenomenon is called field emission. The cathode emitting electrons designed on that principle is referred to as a field emission type cathode (sometimes merely abbreviated as FEC).

Recently, flat, area field emission cathodes each formed of an array of micron-size field emission type cathodes have been able to be manufactured fully using the semiconductor machining technology. The element formed of a great number of FECs on a substrate is used as an electron source for a field emission display (merely abbreviated as FED), lithographic electron beam apparatuses, or the like by irradiating the fluorescent screen with electrons emitted from each emitter.

FIG. 5 is a plan view partially and schematically illustrating a conventional field emission element. FIG. 6 is a cross sectional view illustrating a conventional field emission element taken along the line VI—VI of FIG. 5. Referring to FIG. 5 and FIG. 6, numeral 31 represents a cathode conductor, 32 represents an island region, 33 represents a resistance layer, 1 represents a cathode substrate, 6 represents an insulating layer, 7 represents an emitter cone, and 8 represents a gate electrode.

This prior art is disclosed, for example, in Japanese Patent Laid-open Publication No. 7-153369 (Application No. 5-320923). The cathode conductor 31 and the island electrodes 32 are formed on the cathode substrate 1 such as a glass substrate through the step of patterning a conductive thin film of Nb, Mo, Al, or the like. The island electrodes 32 are surrounded by moats formed in the stripe cathode conductor. Thus the cathode substrate is shaped in a curbed pattern. The island electrode 32 and the cathode substrate 31 are separated from each other by a gap with a predetermined space and are completely isolated on the same plane. A line of cathode electrode is formed of the cathode conductor 31 and the plural island electrodes 32. In the field emission display, plural cathode electrode lines are formed in a stripe pattern and cross perpendicularly to the gate electrode lines 8.

As shown in FIG. 6, a resistance layer 33 made of, for example, amorphous silicon (a-Si) is formed on the cathode conductor 31 and the island electrodes 32. An insulating layer 6 made of a silicon dioxide ($SiO_2$) is formed over the resistance layer 33. The gate electrode 8 made of Nb, Mo, Al, or $WSi_2$ is formed on the insulating layer 6. A plurality of openings are formed through the gate electrode 8 and the insulating layer 6. An emitter cone 7 acting as an emitter electrode (emitter chip) made of Mo is formed on the resistance layer 33 within each of the openings. The tips of the emitter cones 7 are viewed from the anode electrode (not shown) through each of the openings.

In the above-mentioned structure, the emitter cones 7 are electrically connected to the island electrode 32 via the resistance layer 33. Each island electrode 32 is electrically connected to the cathode conductor 31 via the junction of the resistance layer 33. Since the gap between the gate electrode 8 and the tip of the emitter cone 7 is set to the order of submicrons, the emitter cone 7 can field emit electrons by applying a small voltage of several tens of volts. Moreover, since the pitch between the emitters 7 can be set to the order of 5 to 10 $\mu$m, several tens of thousands to several hundreds of thousands emitter cones 7 can be formed on a single cathode substrate 1.

The anode substrate of transparent glass and the cathode substrate 1 are disposed opposite to each other at a predetermined distance. The space between the anode substrate and the cathode substrate 1 are evacuated to a vacuum degree. An anode electrode is formed on the anode substrate to collect electrons emitted from the emitter cones. The electrons impinge the fluorescent substance coated on the anode electrode to glow the fluorescent substance. Plural emitter cones 7 formed on one or plural island electrodes 32 correspond to one display segment. In a color display, the plural emitter cones 7 corresponds to one of red, green and blue colors forming one display segment.

In the conventional structure, the cathode electrode line is divided into the cathode conductor 31; and the island electrode 32 and the resistance layer 33 is formed. The reason is as follows:

Firstly, since the distance between the emitter cone 7 and the gate electrode 8 is very short, the emitter cone 7 may be short-circuited with the gate electrode 8 due to dust during fabrication. Plural cathode electrode lines in the X-direction and plural gate electrode lines in the Y-direction are formed on the cathode substrate 1 in a matrix pattern. Emitter cones 7 corresponding to several hundreds of dots are formed for one cathode electrode line. In order to emit electrons, a specific cone emitter 7 is selected by applying an input signal to the cathode electrode line and a positive voltage to a line of the gate electrodes 8 perpendicular to the cathode electrode line. In this structure, even if one emitter cone 7 is short-circuited, the corresponding cathode electrode line is completely disabled, thus resulting in line malfunction.

Secondly, gases released within the field emission panel at the time of an initial operation may cause a discharge between the emitter cone 7 and the gate electrode 8 or the anode electrode, so that the excessive current often destroys the cathode electrode. Moreover, some of a great number of emitter cones 7 tend to easily emit electrons, thus producing abnormal bright spot on the screen.

To avoid such phenomena, the resistance layer 33 is disposed between the emitter cone 7 and the cathode substrate 31. When a specific emitter cone 7 emits excessive electrons, the resistance layer 33 increases its voltage drop according to the increasing current to suppress the electron emission, so that a burst of electron emission can be prevented. Hence the resistance layer 33 can prevent current from locally concentrating to the specific emitter cone 7. This feature allows the yield in fabrication to enhance and the operation of the system to stabilize.

Thirdly, when emitter cones are directly formed on the resistance layer 33, without forming the island 32, the resistance between the cathode electrode 31 and each emitter cone 7 depends on the distance therebetween. That is, the emitter cone formed near the cathode conductor 31 has a low resistance value. The emitter cone distant from the cathode conductor 31 formed on the middle portion of the group of the emitter cones 7 has a high resistance value. This means that the emitter cone 7 adjacent to the cathode conductor 31 emits a large amount of electrons while the emitter cone 7 at the middle portion emits a small amount of electrons. Hence, the electron emission amount becomes uneven.

To overcome such problems, open spaces are formed in the cathode conductor 31. The island electrodes 32 isolated from the cathode conductor 31 are formed within the open spaces. Plural emitter cones 7 are formed on each of the island electrodes 32. This structure can uniform the resistance values between the cathode conductor 31 and respective emitter cones 7, thus equalizing the electron emission characteristics.

SUMMARY OF THE INVENTION

The present invention is made to overcome the above-mentioned problems. The object of the invention is to provide a field emission element with an improved structure.

Another object of the present invention is to provide a field emission element that can prevent one cathode electrode line from being completely disabled due to a short circuit or discharge between an emitter electrode and a gate electrode, compared with the prior art field emission element.

According to a first aspect of the present invention, a field emission element comprises a cathode conductor; plural island electrodes; a high resistance layer; plural low resistance layers respectively formed on the plural island electrodes; and plural emitter electrodes formed directly on each of the plural island electrodes or formed on each of the plural island regions via the high resistance layer; each of the island electrodes being connected to the cathode conductor via the high resistance layer and a low resistance layer serially connected.

Hence, when an excessive current flows through an island electrode due to a discharge between an emitter electrode and a gate electrode, the portion where the high resistance layer and the low resistance layer are serially connected to each other is destroyed due to heating, so that only the emitter electrodes formed on the island electrode can be disabled from emitting electrons. Thus it can be avoided that one cathode electrode line becomes completely out of control.

In the field emission element according to the present invention further comprises a cathode substrate; an insulating layer; and a gate electrode; wherein the cathode conductor and the plural island electrodes are formed on the cathode substrate; wherein a first portion of the high resistance layer is formed on the island electrodes while a second portion of the high resistance layer electrically connects the cathode conductor and each of the island electrodes; wherein the low resistance layers are formed on the second portion of the high resistance layer; wherein the insulating layer is formed over the high resistance layer and the low resistance layers; wherein the gate electrode is formed on the insulating layer; first openings being formed through the gate electrode and the insulating layer overlaying each of the island electrodes; and wherein the plural emitter electrodes are respectively disposed in the first openings and are formed on each of the island electrodes via the first portion of the high resistance layer.

Hence, the structure where each island electrode is connected to the cathode conductor via the high resistance layer and a low resistance layer serially connected can be easily fabricated. The layer structure in which the high resistance layer can be easily thinned improves the productivity. Since the high resistance layer can be formed of a material of a large volume resistivity ρ, the second portion of the high resistance layer can be set to a large resistance value.

In the field emission element according to the present invention, second openings are formed in the insulating layer overlaying the low resistance layers.

The low resistance layer is exposed from the insulating layer. Hence, when a defect or possible defect is found in the opening in a gate electrode or at an emitter cone or island electrode in the course of fabrication, the low resistance layer at the failed portion can be melted with the laser beam. Hence, the failed portion can be previously separated off from the cathode conductor.

Moreover, according to the present invention, the field emission element further comprises a cathode substrate; an insulating layer; and a gate electrode; wherein the cathode conductor and the plural island electrodes are formed on one surface of the high resistance layer; wherein the insulating layer is formed on the high resistance layer on which the island electrodes and the cathode conductor are formed; wherein the gate electrode is formed on the insulating layer; first openings being formed through the gate electrode and the insulating layer overlaying each of the island electrodes; wherein the plural emitter electrodes are respectively disposed in the first openings and are formed on each of the island electrodes; wherein the low resistance layer are formed on the other surface of the high resistance layer which electrically connects the cathode conductor to each of the island electrodes; wherein the cathode substrate is disposed on the other surface of the high resistance layer which has one surface on which the low resistance layers are formed.

Hence, the structure where each island electrode is connected to the cathode conductor via the high resistance layer and a low resistance layer serially connected can be easily fabricated. The layer structure in which the high resistance layer can be easily thinned improves the productivity. Since the high resistance layer can be formed of a material of a large volume resistivity ρ, the second portion of the high resistance layer can be set at a large resistance value.

The above and other objects, features and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

The embodiments according to the present invention will now be described below in detail with reference to the attached drawings.

Figure 1:
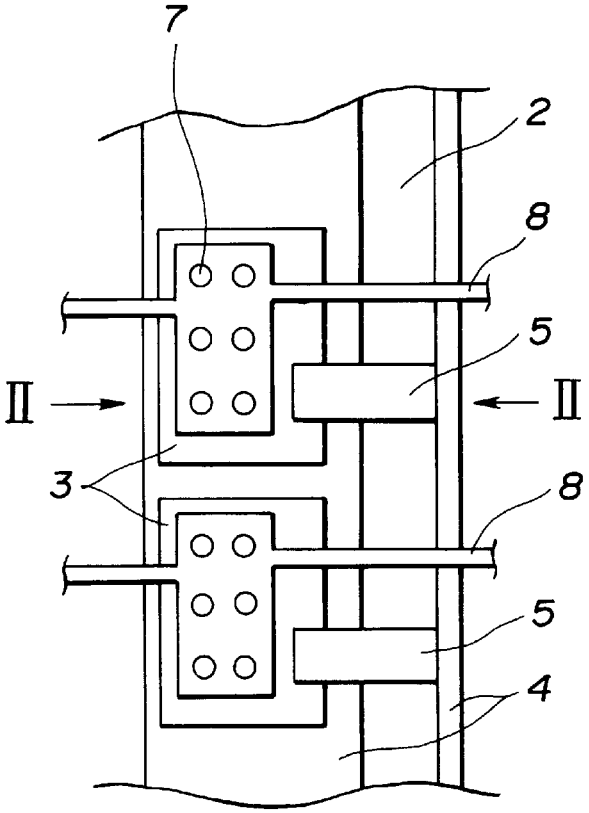
FIG. 1 is a plan view partially and schematically illustrating a field emission element according to a first embodiment of the present invention.
Figure 2:
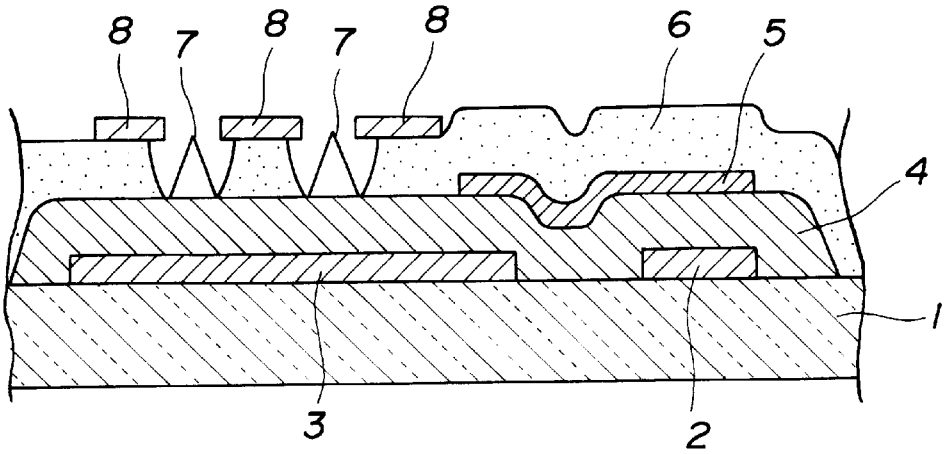
FIG. 2 is a cross sectional view illustrating a field emission element taken along the line II—II of FIG. 1.
Figure 5:
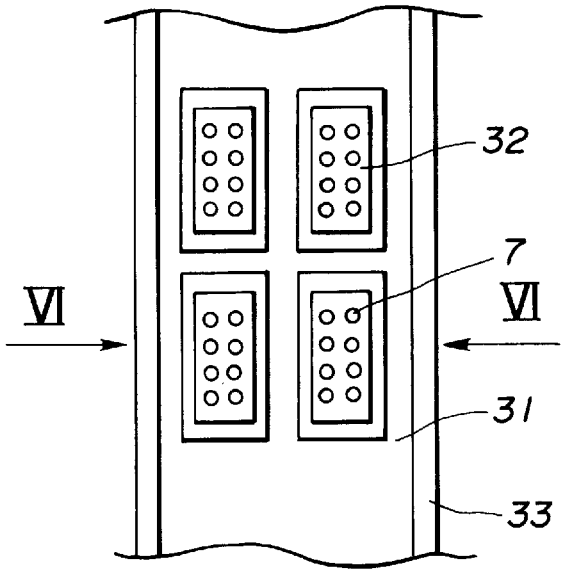
FIG.5 (PRIOR ART)
FIG. 5 is a plan view partially and schematically illustrating a conventional field emission element.

FIG. 1 is a plan view partially and schematically illustrating a field emission element according to a first embodiment of the present invention. FIG. 2 is a cross sectional view illustrating a field emission element taken along the line II—II of FIG. 1. The same numerals are attached to the same constituent elements as those in FIGS. 5 and 6. Hence, the duplicate description will be omitted here. Numeral 2 represents a cathode conductor; 3 represents an island electrode; 4 represents a first resistance layer; and 5 represents a second resistance layer. In FIG. 1, the gate electrode 8 is depicted but the insulating layer 6 is removed to show the topography of the lower structure.

In this embodiment, a first resistance layer 4 and a second resistance layer 5 each having a different resistance value are laminated as the current control resistance layer. The island electrode 3 is laterally isolated from the cathode conductor 2 such that the laminated thick-layer portion is destroyed when an excessive current flows through the emitter cone 7 or an excessive voltage is applied to the emitter cone 7. For example, if the gate electrode 8 is short-circuited to the emitter cone 7, only the island electrode 3 electrically connected to the defect emitter cone 7 can be electrically separated off from the cathode conductor 2.

In explanation, it is now assumed that one cathode electrode line is formed of a straight cathode conductor 2 and plural island electrodes 3 arranged on one side of the straight cathode conductor 2. The gate electrode 8 is formed on the insulating layer 6 corresponding to each island electrode 3. A narrow connection portion horizontally extends to configure a gate electrode line perpendicular to the cathode electrode line. The second resistance layer 5 is locally laminated on the first resistance layer 4 overlaying each of plural island electrodes 3. The second resistance layer 5 bridges the gap region between the island electrode 3 and the cathode line 2 and is in parallel to the connection portion of the gate electrode 8.

Figure 6:
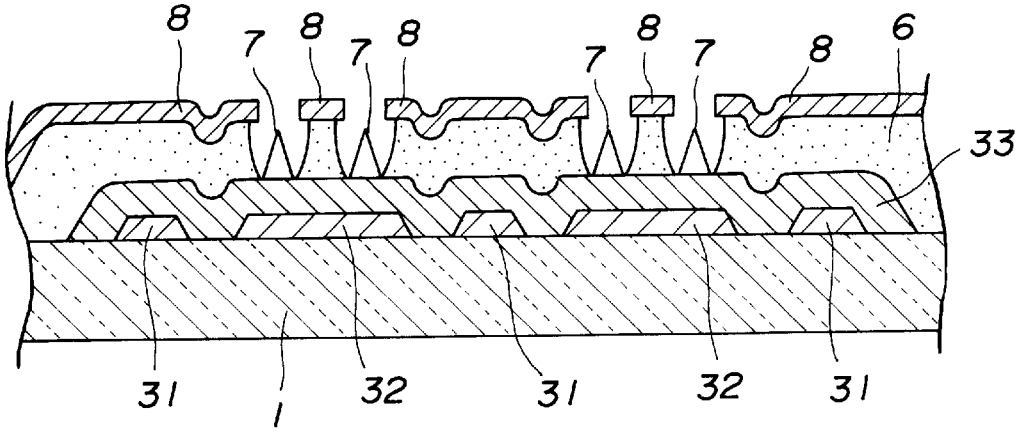
FIG.6 (PRIOR ART)
FIG. 6 is a cross sectional view illustrating a conventional field emission element taken along the line VI—VI of FIG. 5.

The cross structure of FIG. 2 differs from the prior art of FIG. 6 in the existence of the second resistance layers 5. The cathode conductor 2 and the island electrode 3 are made of the same metal material as those in the cathode conductor 31 and the resistance layer 32 shown in FIG. 6. The first resistance layer 4 is made of amorphous silicon (a-Si), like the resistance layer 33 of FIG. 6. The cathode conductor 2 and the island electrode 3 are formed on the cathode substrate 1. The first resistance layer 4 covers the cathode conductor 2 and the island electrode 3. That is, the first resistance layer 4 is formed on the island electrode 3 and electrically connects the cathode conductor 2 to the island electrode 3.

The second resistance layer 5 is formed on the first resistance layer 4 overlaying the gap region which electrically connects the cathode conductor 2 to the island electrode 3. An insulating layer 6 is formed over the first resistance layer 4 and the second resistance layer 5. A gate electrode 8 is formed on the insulating layer 6. Plural openings are formed through the gate electrode 8 and the insulating layer 6. An emitter cone 7 is formed on the first resistance layer 4 within each opening. The tip of the emitter cone 7 is viewed from the anode electrode (not shown) through the opening. The first resistance layer 4 is disposed for each cathode electrode line and is isolated from the first resistance layer associated with the neighbor cathode electrode line by means of the insulating layer 6. The first resistance layer 4 has a resistance value relatively higher than that of the second resistance layer 5.

The first resistance layer 4 controls the current from plural emitter cones 7 in one island electrode 3. The resistance value of the first resistance layer 4 is set based on the current amount emitted from the emitter cone 7 as well as the generated electromotive force potential for feedback control. Generally, the resistance film of a volume resistivity $\rho$ ($\Omega$cm) is expressed by $R=\rho\ L/A$, where A is an area ($cm^2$) confronting the electrode and L is a thickness (cm) of a resistance film. Hence, the resistance value of the first resistance layer 4 between plural emitter cones 7 and the island electrode 3 is proportional to the thickness and volume resistivity of the first resistance layer 4. Thinning the thickness of the resistance layer improves the productivity.

Hence the resistance value of the first resistance layer 4 is set to a predetermined value and the volume resistivity is set to a large value by thinning the film thickness. In such a design, the region between the cathode conductor 2 and the island electrode 3 has a large resistance value and acts as an insulating layer. This layer structure allows the first resistance layer 4 and the second resistance layer 5 to have a resistance value largely different from each other.

As a result, plural emitter cones 7 are electrically connected to the island electrode 3 via the first resistance layer 4. The island electrode 3 is connected to the cathode conductor 2 via the first resistance layer 4 as well as via the first resistance layer 4 and the second resistance layer 5 serially connected. In this structure, the composite emitter current due to the emission of emitter cones 7 vertically flows from the first resistance layer 4 to the island electrode 3, then vertically flows from the island electrode 3 to the first resistance layer 4, and finally flows from the second resistance layer 5 to the cathode conductor 2 via the first resistance layer 4.

The total emitter current from the emitter cones 7 formed on the island electrode 3 can be controlled by adjusting the resistance value of the second resistance layer 5. This defines the electron emission amount corresponding to each display segment. Hence, the characteristics between the display segments can be equalized by controlling the resistance value of the second resistance layer 5. The resistance value of the second resistance layer 5 can be optimized by adjusting the area of the second resistance layer 5.

If an excessive current over a normal value flows through the island electrode 3 because of a short-circuit between a gate electrode 8 and an emitter cone 7 and an excessive voltage applied to an emitter cone electrode 7, the first resistance layer 4 which is between the island electrode 3 and the second resistance layer 5 or between the second resistance layer 5 and the cathode conductor 2, having a larger resistance value than that of the second resistance layer 5, is thermally destroyed. Even if the cathode conductor 2 and the gate electrode 8 are in contact with the second resistance layer 5 in the destroyed state, excessive current again flows through the contact portion when a voltage is applied to the cathode conductor 2 and the island electrode 3 in the next scanning operation. As a result, the second resistance layer 5 is completely thermally destroyed and is separated off from the cathode conductor 2. The connection line region of the gate electrode 8 does not cross the second resistance layer 5 because breakage of the laminated portion of the first resistance layer 4 and the second resistance layer 5 may adversely affect the connection line region of the gate electrode 8.

Since the island electrode 3 undergone by the excessive current is cut off from the cathode conductor 2, the electron emission operation becomes disabled. Thus other island electrodes 3 can normally emit electrons. Therefore, although one display segment corresponding to plural emitter cones 7 on an island electrode 3 is broken, it can be prevented that one display line is exterminated.

An embodiment will be described here to form the first resistance layer 4 and the second resistance layer 5 having a different resistance value to each other. The first resistance layer 4 is made of amorphous silicon (a-Si). The second resistance layer 5 is made of indium-tin-oxide (ITO). The substance a-Si greatly changes its resistance value with the ambient temperatures. In contrast, ITO stably maintains its resistance value to the ambienttemperatures. The second resistance layer may be a resistance layer of a metal thin film. With no second resistance layer 5, the resistance value of the region between the island electrode 3 and the cathode conductor 2 is set to about 1000 MΩ while the second resistance layer is set to several Ω to several hundreds Ω. With the second resistance layer 5 laminated, the first resistancelayer 4 between the island electrode 3 and the second resistance layer 5 is set to about 1 MΩ while the first resistance layer 4 between the second resistance layer 5 and the cathode conductor 2 is set to about 1 MΩ.

Figure 3:
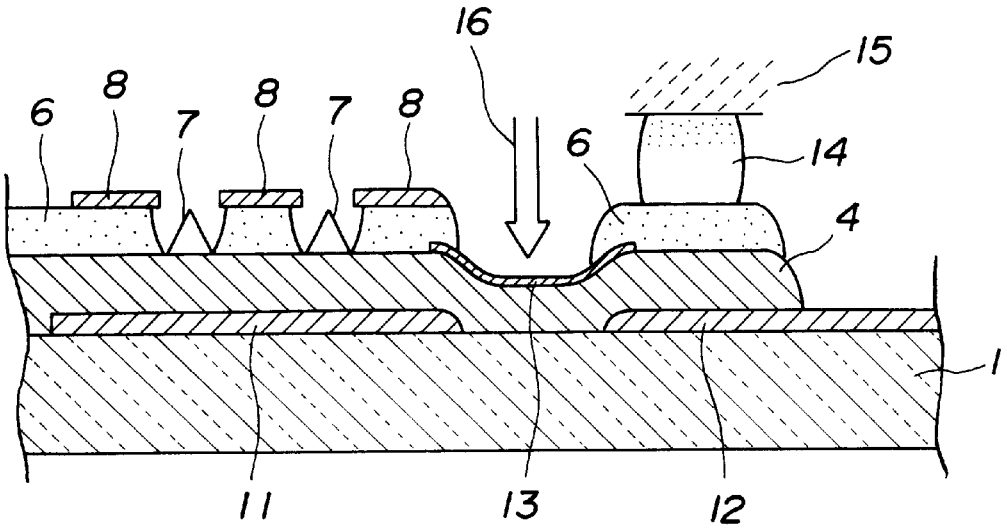
FIG. 3 is a cross sectional view illustrating a field emission element according to a second embodiment of the present invention.

FIG. 3 is a cross sectional view illustrating a field emission element according to the second embodiment of the present invention. In FIG. 3, the same numerals are attached to the same constituent elements as those in FIGS. 5 and 6. Hence the duplicate description will be omitted here. Numeral 11 represents an island electrode; 12 represents a cathode conductor; 13 represents a second resistance layer; 14 represents a sealing compound; 15 represents an anode substrate; and 15 represents a laser beam. Like the prior art structure shown in FIGS. 5 and 6, it is now assumed that the cathode conductor 12 of this embodiment is shaped in a curbed pattern; and the island electrode 11 is separated from and surrounded by the cathode conductor 12.

FIG. 3 shows the cross sectional view illustrating a field emission element longitudinally taken along the cathode conductor 12. FIG. 3 partially shows the sealing portion 14 and the island electrode 11 adjacent to the sealing portion 14 in the vacuum hermetic enclosure of a field emission display. The insulating layer 6 is welded with the anode substrate 15 to assemble a vacuum hermetic enclosure. The anode electrode 12 serves as a cathode terminal extended from between the cathode substrate I and the first resistance layer 4 and taken out of the envelope.

This embodiment has nearly the same cross section as the first embodiment shown in FIG. 2. However, the insulating layer 6 on the second resistance layer 13 is selectively etched off to form an opening so that part of the second resistance layer 13 is exposed. If a defect is found in the opening for the gate electrode 8, the emitter cone 7, or the island electrode 11 by checking the cathode side in the course of the fabrication process, the second resistance layer 13 can be fused with the laser beam 16 to separate off the island electrode 11 from the cathode conductor 12. In this operation, the yield on the cathode side can be improvedby previously disabling the failed segment during the manufacturing process.

Figure 4:
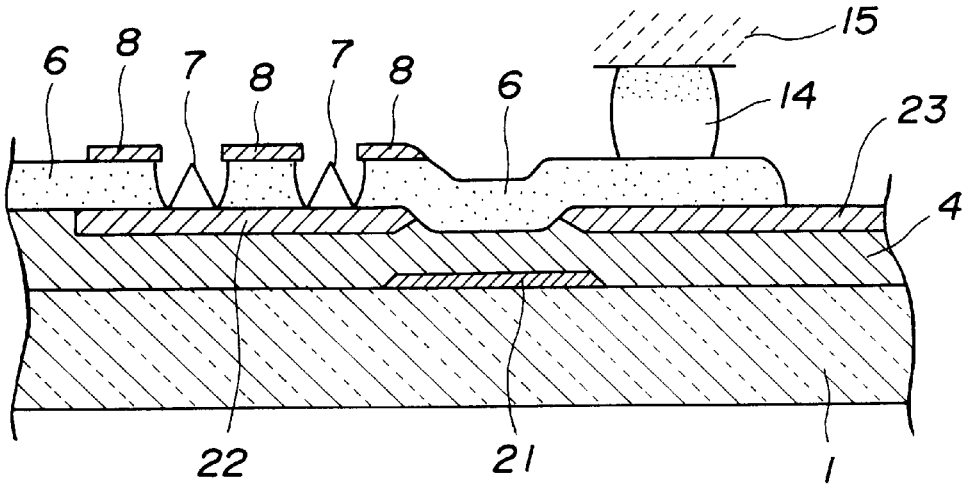
FIG. 4 is a cross sectional view illustrating a field emission element according to a third embodiment of the present invention.

FIG. 4 is a cross sectional view illustrating a field emission element according to the third embodiment of the present invention. In FIG. 4, the same numerals are attached to the same constituent elements as those in FIGS. 1, 2, 5 and 6. Hence the duplicate description will be omitted here. Numeral 21 represents a second resistance layer, 22 represents an island electrode, and 23 represents a cathode electrode. Like the embodiment shown in FIG. 3, it is now assumed that the cathode conductor 23 of this embodiment is shaped in a curbed pattern; and the island electrode 22 is in the cathode conductor 23. FIG. 4 is the cross sectional view illustrating a field emission element longitudinally taken along the cathode conductor 23. FIG. 4 partially shows the sealing portion 14 and the island electrode 22 adjacent to the sealingportion 14 in the vacuum hermetic enclosure of a field emission display. The cross sectional structure in the third embodiment differs from that of the first embodiment shown in FIG. 2 in that the emitter electrode 7 is directly connected to the island electrode 22.

The second resistance layer 21 is locally formed on the cathode substrate 1. The first resistance layer 4 is formed on the cathode substrate 1 and the second resistance layer 21. The insulating layer 6 is formed over the first resistance layer 4 through the cathode conductor 23 and the island electrode 22. The gate electrode 8 is formed on the insulating layer 6. Openings are formed through the gate electrode 8 and the insulating layer 6 on the island electrode 22. Plural emitter electrodes 7 are respectively formed on the island electrode 22 in the openings. The second resistance layer 21 is disposed under the gap region between the cathode conductor 23 and the island electrode 22 and on the lower surface of the first resistance layer 4.

In this embodiment, plural emitter cones 7 are electrically connected to the island electrode 22. The island electrode 22 is connected to the cathode conductor 23 serially via the first high resistance layer 4 and to the cathode conductor 23 via the first resistance layer 4 and the second low resistance layer 21 providedto each island electrode 22. In this structure, the total emitter current due to electrons emitted from emitter cones 7 chiefly flows from the island electrode 22 to the cathode conductor 23 via the first resistance layer 4 and the second resistance layer 21 and via the first resistance layer 4. The electrons can be stably and uniformly emitted depending on the resistance value of the first resistance layer 4 between the island electrode 22 and the second resistance layer 21 as well as the resistance of the first resistance layer 4 between the cathode conductor 23 and the second resistance layer 21.

If excessive current flows through the island electrode 22, the first resistance layer 4 is thermally broken because of its resistance value higher than that of the second resistance layer 21, so that the island electrode 22 can be electrically cut off from the cathode conductor 23. In this embodiment, the first resistance layer 4 underneath the island electrode 22 is not essential because of its less contribution in function.

In the above-mentioned embodiments, the second resistance layer disposed between an island electrode and a cathode conductor hasbeen described. As disclosed in Japanese Patent laid-open publication No. 9-92131 (application No. 7-270737), a variation in brightness sometimes occurs in a display image according to coordinates on the two-dimensional plane of a field emission display. In the second resistance layers disposed corresponding to all island electrodes two-dimensionally arranged, each resistance value can be arbitrarily set in the two-dimensional plane by adjusting the width and length of the second resistance layer in fabrication. Hence, positional variations in the two dimensional plane of the electron emission characteristics of a field emission display can be canceled and uniformed by adjusting the resistance value.

Moreover, as disclosed the above-mentioned prior art reference, the color field emission display requires to compensate for the color balance of each of the three luminous colors (white balance). The luminous brightness of each color can be set to a suitable value by differentiating the resistance value of the low resistance layer formed on an island electrode according to whether or not which of phosphor dots for three primary colors is struck by the electrons emitted from an island electrode. That is, the resistance values of low resistance layers respectively formed on the island electrodes differ according to the luminous color of phosphor glowed by electrons emitted from the corresponding island electrode.

In the above-mentioned embodiments, one island electrode corresponds to one display segment. However plural island electrodes may correspond to one display segment. In such a case, if an island electrode is cut off from the cathode conductor due to an excessive current, the remaining island electrodes corresponding to the display segment can emit a reduced amount of electrons, so that the display segment will not be completely damaged. In the color display, plural island electrodes can be handled corresponding to one luminous color within one display segment.

In the above-mentioned embodiments, the first resistance layer is formed between the island electrodes and the cathode conductor; and the second resistance layer is formed on the first resistance layer. This laminated structure can be easily fabricated. However, the structure according to the present invention should not be limited only to the laminated structure. Each island electrode may be connected to the cathode conductor via the first high resistance layer and the second low resistance layer serially connected. In such a configuration, since the first high resistance layer 4 is thermally destroyed due to excessive current flowing through one island electrode, the island electrode is electrically separated off from the cathode conductor. By setting the second resistance layer to a relatively high value, the second resistance layer can be directly and respectively connected to island electrodes without disposing the first resistance layer.

As clearly understood from the above description, the field emission element according to the present invention has the advantage that a line defect can be avoided even if a short-circuit should occur between the gate electrode and the cathode conductor. As a result, the product yield at the inspection prior to shipment can be greatly improved and the line defect can be avoided even if a short-circuit occurs in use of the display. Hence, the serviceable life of the display can be greatly prolonged.

Moreover, a damaged or possibly-damaged island electrode can be previously separated off from the cathode conductor at the inspection step in fabrication.

The present invention has the advantage of realizing the improved productivity and reduced fabrication costs because the first resistance layer can be thinned.

The material a-Si for the first resistance layer largely changes its resistance value with environmental temperatures. However the temperature characteristics of the entire resistance layer can be stabilized by using a material such as ITO immune to environmental temperatures as a material for the second resistance layer. Thus the performance of the display can be improved.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A field emission element comprising:

a cathode conductor;

plural island electrodes;

a high resistance layer;

plural low resistance layers respectively formed on said plural island electrodes; and plural emitter electrodes formed on each of said plural island regions via said high resistance layer, wherein each of said island electrodes are connected to said cathode conductor via said high resistance layer and a respective serially connected low resistance layer formed on a part of the high resistance layer bridging a gap between the cathode conductor and a respective island electrode.

2. The field emission element defined in claim 1, further comprising:

a cathode substrate;

an insulating layer formed over the high resistance layer and the low resistance layer; and a gate electrode formed on the insulating layer; and first openings formed through the gate electrode and the insulating layer overlaying each of the island electrodes;

wherein said cathode conductor and said plural island electrodes are formed on said cathode substrate;

wherein a first portion of said high resistance layer is formed on said island electrodes while a second portion of said high resistance layer electrically connects said cathode conductor and each of said island electrodes; and wherein said plural emitter electrodes are respectively disposed in said first openings and are formed on each of said island electrodes via said first portion of said high resistance layer.

3. The field emission element defined in claim 2, further comprising:

second openings formed in said insulating layer overlaying said low resistance layers.

4. A field emission element comprising:

a cathode substrate;

a low resistance layer formed on a portion of the cathode substrate;

a high resistance layer formed over the low resistance layer and the cathode substrate;

a cathode conductor;

plural island electrodes;

plural emitter electrodes formed directly on each of the plural island electrodes;

an insulating layer;

a gate electrode formed on the insulating layer; and first openings formed through the gate electrode and the insulating layer overlaying each of the island electrodes;

wherein said cathode conductor and said plural island electrodes are formed on one surface of said high resistance layer;

wherein said insulating layer is formed on said high resistance layer on which said island electrodes and said cathode conductor are formed;

wherein said plural emitter electrodes are respectively disposed in said first openings and are formed on each of said island electrodes;

wherein said low resistance layers are formed on the other surface of said high resistance layer which electrically connects said cathode conductor to each of said island electrodes; and wherein said cathode substrate is disposed on the other surface of said high resistance layer which has one surface on which said low resistance layers are formed.

5. A field emission device comprising:

a substrate;

a mesh-shaped cathode conductor disposed on the substrate;

a plurality of island-shaped electrodes disposed within open spaces of the mesh-shaped cathode conductor;

a first resistance layer formed over the cathode conductor and the plurality of island-shaped electrodes;

a plurality of emitter electrodes respectively disposed on each of the plurality of island-shaped electrodes via the first resistance layer; and a second resistance layer formed only on a part of the first resistance layer which bridges a gap between the cathode conductor and a respective island-shaped electrode, wherein the cathode conductor and the respective island-shaped electrode are connected via the first and second resistance layers.

6. The field emission device according to claim 5, wherein the first resistance layer comprises a larger resistance than the second resistance layer.

7. The field emission device according to claim 5, wherein the plurality of emitter electrodes comprise cone-shaped emitter electrodes.

8. The field emission device according to claim 5, further comprising:

an insulating layer formed over the first and second resistance layers;

a gate electrode including a layer of conductive material formed over the insulating layer; and a plurality of first openings respectively formed through the gate electrode and the insulating layer overlaying each of the island-shaped electrodes.

9. The field emission device according to claim 5, further comprising:

a plurality of second openings formed through the insulating layer at positions in which the insulating layer covers the second resistance layer.

10. A field emission device comprising:

a substrate;

a first resistance layer formed on a portion of the substrate;

a second resistance layer formed over the first resistance layer and the substrate;

a mesh-shaped cathode conductor disposed on the second resistance layer;

a plurality of island-shaped electrodes disposed on the second resistance layer at positions within open spaces of the mesh-shaped cathode conductor; and a plurality of emitter electrodes respectively disposed directly on each of the plurality of island-shaped electrode;

wherein the cathode conductor and the respective island-shaped electrode are connected via the first and second resistance layers.

11. The field emission device according to claim 10, wherein the second resistance layer comprises a larger resistance than the first resistance layer.

12. The field emission device according to claim 10, wherein the plurality of emitter electrodes comprise cone-shaped emitter electrodes.

13. The field emission device according to claim 10, further comprising:

an insulating layer formed over the second resistance layer, the cathode conductor and the plurality of island-shaped electrodes;

a gate electrode including a layer of conductive material formed over the insulating layer; and a plurality of first openings respectively formed through the gate electrode and the insulating layer overlaying each of the island-shaped electrodes.

* * * * *